US008151386B2

(12) United States Patent
McKee

(10) Patent No.: US 8,151,386 B2
(45) Date of Patent: Apr. 10, 2012

(54) BED COVER SYSTEM

(76) Inventor: M'Lisa K. McKee, Boulder, CO (US)

( * ) Notice: Subject to any disclaimer, the term of this patent is extended or adjusted under 35 U.S.C. 154(b) by 0 days.

(21) Appl. No.: 12/191,139

(22) Filed: Aug. 13, 2008

(65) Prior Publication Data

US 2009/0044337 A1 Feb. 19, 2009

Related U.S. Application Data

(60) Provisional application No. 60/955,763, filed on Aug. 14, 2007.

(51) Int. Cl.
*A47C 31/02* (2006.01)

(52) U.S. Cl. ..... 5/500; 5/497; 5/498; 5/502

(58) Field of Classification Search ..... 5/482, 488, 5/495–500, 502, 413 R, 485, 486
See application file for complete search history.

(56) References Cited

U.S. PATENT DOCUMENTS 3,857,124 A * 12/1974 Hadley ..... 5/496
6,098,219 A * 8/2000 Milber ..... 5/494
6,886,197 B1 * 5/2005 Madigan ..... 5/482
7,086,102 B1 * 8/2006 Frazier ..... 5/502

FOREIGN PATENT DOCUMENTS

WO WO 2007023256 A1 * 3/2007

* cited by examiner

*Primary Examiner* — Robert G Santos
*Assistant Examiner* — Nicholas Polito
(74) *Attorney, Agent, or Firm* — Pate Baird, PLLC

(57) ABSTRACT

Disclosed is a bed sheet and blanket system and method including a fitted foundation and a selectively detachable connecting sheet or blanket. Embodiments of the invention include a second connecting sheet or blanket disposed above or on top of the first connecting sheet or blanket. The fitted foundation, the first connecting sheet or blanket, and the second connecting sheet or blanket may be connected through interconnecting components such as zippers.

17 Claims, 7 Drawing Sheets

BED COVER SYSTEM

RELATED APPLICATIONS

This application claims the benefit of co-pending U.S. Provisional Patent Application Ser. No. 60/955,763, filed Aug. 14, 2007 and entitled BED COVER SYSTEM.

FIELD OF THE INVENTION

The present invention relates to interconnecting bed sheets and blankets into a bed system.

SUMMARY

A familiar problem known to many parents is the daily task of making a child's bed. This daily chore can become tedious and time consuming, particularly in large households having several beds. Additionally, if children sleep in bunk beds, the difficulty of making the bed is increased. In particular, the mattress may be difficult to access due to its position against a wall or on the top level of the bunk bed. As a result, the daily task of making the beds can become quite taxing.

In some households a child may be responsible for making his or her own bed. If this is the case, parents may have difficulty enforcing this requirement of the children. Children, in their haste, may prove to have little patience for the details involved in making a bed. In particular, a fitted sheet must be placed on the mattress. Then, a top sheet must be placed over the fitted sheet and neatly tucked between the mattress and a box spring or a bed frame. Every morning, the top sheet must be placed back in its proper position. For children who are easily distracted, eager to be involved in other things, or both, these few tasks can prove difficult.

One prior art solution to this problem is to allow children to sleep on their mattress in a sleeping bag. In the morning, making the bed only involves zipping up the sleeping bag. However, this solution suffers from several drawbacks. In particular, with the sleeping bag on the bed, the bed continues to have a unkempt appearance. Additionally, the sleeping bag is of a unitary construction that does not facilitate washing.

Accordingly, it would be desirable to have a cover system that greatly reduces the time needed to make a bed, and is also easy to wash. As used herein, a "cover" can include a sheet or a blanket. Additionally, it would be desirable to have such a system adapted for use with a bunk bed and usable by children responsible for making their beds. The present invention is directed to a bed sheet and blanket system and method for making a bed that addresses these and other needs.

The present invention is directed to a bed sheet and blanket system including a bottom or a foundation fitted to a mattress and one or more selectively detachable sheets. The fitted foundation is fitted to a mattress sleeping surface portions. The fitted foundation interconnects to connecting sheets, blankets, or both through interconnecting components, such as zippers. The connecting sheet and a portion of the foundation sheet together form a pocket that provides a space for a person to lie in while sleeping. The bed sheet and blanket system of the present invention may include a second connecting sheet or blanket which may lie on top of or above the first connecting sheet and be interconnected to either the first connecting sheet or to the foundation sheet. Any of the sheets and blankets, including the second connecting sheet or blanket, may include a decorative pattern, such as a cartoon character or other design pleasing to children.

In accordance with embodiments of the present invention, the interconnecting components used to interconnect the various sheets may be zippers. In accordance with other embodiments of the present invention, interconnecting components may include devices such as snaps, buttons, hook-and-loop, or other fasteners. On the fitted foundation, an attaching component may be disposed along a perimeter or a portion of a perimeter of the sleeping surface. On the connecting sheet(s) an attaching component may be disposed along a perimeter or a portion of a perimeter of the entire sheet.

In accordance with embodiments of the present invention, the pocket that provides a sleeping space may be provided between the first connecting sheet and the second connecting sheet. In that regard, the first connecting sheet may connect to the foundation sheet along the complete perimeter of the sleeping surface. The second connecting sheet may then interconnect to either the foundation sheet or to the first connecting sheet.

Various embodiments of apparatus in accordance with the present invention are set forth in the attached figures and in the detailed description of the invention as provided herein and as embodied by the claims. It should be understood, however, that this Summary does not contain all of the aspects and embodiments of the present invention, is not meant to be limiting or restrictive in any manner, and that the invention as disclosed herein is and will be understood by those of ordinary skill in the art to encompass obvious improvements and modifications thereto.

Additional advantages of the present invention will become readily apparent from the following discussion, particularly when taken together with the accompanying drawings.

DETAILED DESCRIPTION

The present invention is directed to a bed cover system and a method of using a bed cover system. As used herein, a "covering" can include a sheet or a blanket. The bed cover system of the present invention provides a sleeping arrangement including two or more sheets or blankets which are selectively detachable from each other. The layers (e.g., sheets, blankets, or both) are easily taken apart by the operation of attaching components, such as zippers. The sheets or blankets may be completely taken apart to wash and/or store the sheets. Additionally, the sheets or blankets may be partially taken apart to provide access to a sleeping space associated with the sheet and blanket system. The bed sheet and blanket system is particularly suited to providing added convenience to the daily routine of either an adult or a child.

Figure 1:
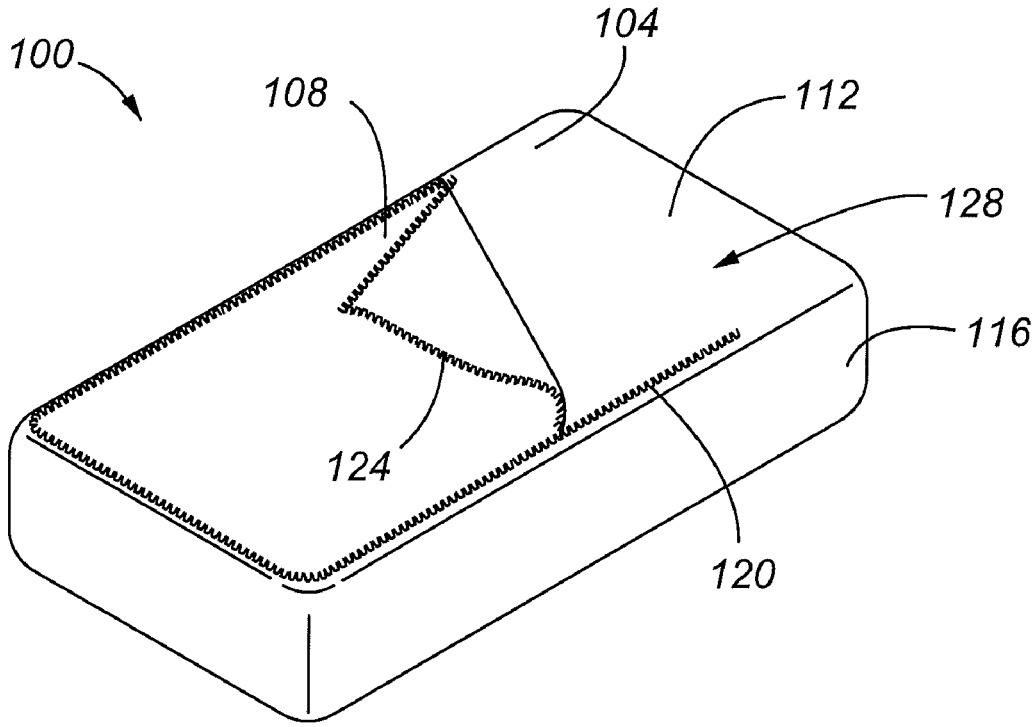
FIG. 1 is a perspective view of a bed sheet and blanket system in accordance with embodiments of the present invention.

Referring now to FIG. 1, a bed sheet and blanket system in accordance with embodiments of the present invention is generally identified by reference numeral 100. The bed sheet and blanket system 100 is shown attached to a mattress and includes a fitted (e.g., matched, fitted, lower sheet 104) foundation 104 and a first connecting sheet 108 or blanket 108. The fitted foundation 104 includes a substantially rectangular sleeping surface 112 and a fitted portion 116 depending therefrom. As can be appreciated by one of skill in the art, a fitted sheet such as the fitted foundation 104, typically includes a single piece of material, sewn such that it takes on a three dimensional shape of a mattress therein, as depicted in FIG. 1, when the sheet or blanket is attached to a mattress. In that regard, the fitted foundation 104 may include an elastic portion that is adapted to grip the corners and the underside of the mattress.

The fitted foundation 104 of the present invention additionally includes a first interconnecting component 120, a portion of which is shown in FIG. 1. The first interconnecting component 120 is operatively associated with a second interconnecting component 124 disposed on the first connecting sheet 108. Together, the first 120 and second interconnecting components 124 may constitute a zipper. However, other attaching mechanisms, such as buttons, snaps, and hook-and-loop fasteners are considered within the scope of the invention. By releasing or disconnecting the first 120 and second interconnecting components 124 from one another, the first connecting sheet 108 may be completely detached from the fitted foundation 104.

A pocket 128 is formed between the first connecting sheet 108 and the fitted foundation sheet 104, when the two sheets are attached. The pocket 128 provides a sleeping space in which a person may lie while sleeping or otherwise using the sheet system 100. The pocket 128 may be accessed by partially detaching the first connecting sheet 108 from the fitted foundation 104, as shown in FIG. 1. Alternatively, the pocket 128 may be accessed without detaching the first connecting sheet 108 from the fitted foundation 104. In accordance with embodiments of the present invention, the first connecting sheet 108 may comprise a larger surface area than the sleeping surface 112 of the fitted foundation 104, so that the pocket 128 includes adequate space to accommodate a person.

Figure 2:
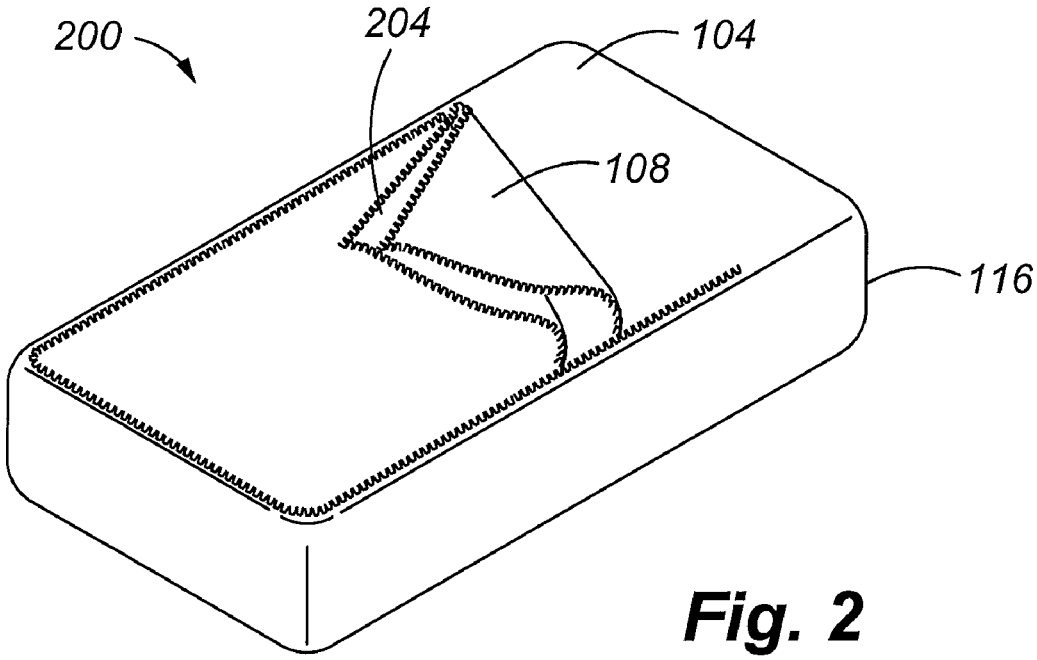
FIG. 2 is a perspective view of a bed sheet and blanket system in accordance with another embodiment of the present invention.

Embodiments of the present invention include a second connecting sheet or blanket which, in use, lies on top of the first connecting sheet. A bed sheet and blanket system 200 including a second connecting sheet or blanket 204 is shown in FIG. 2. The second connecting sheet or blanket 204 may be completely detachable from the first connecting sheet 108 or may remain permanently connected to the blanket 204 along one or more edges, and may be connected to the foundation 104 along a single edge.

Alternatively, the second connecting sheet or blanket 204 may include a fixed connection to the first connecting sheet 108. For example, the second connecting sheet or blanket 204 may include a portion that is sewn or stitched to the first connecting sheet 108.

Figure 3:
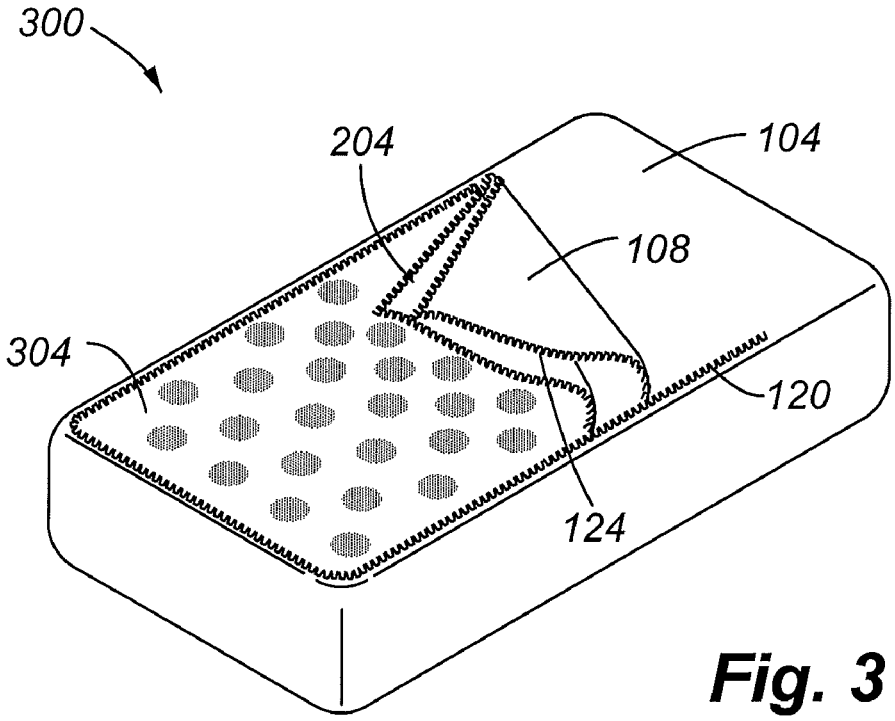
FIG. 3 is a perspective view of a bed sheet system in accordance with yet another embodiment of the present invention.

In accordance with embodiments of the present invention, the second connecting sheet or blanket 204 may include a decorative pattern. A bed sheet and blanket system 300 including a second connecting sheet or blanket 204 having a decorative pattern 304, is shown in FIG. 3. The decorative pattern 304 may include patterns or pictures that may be pleasing to children or adults who use the sheet and blanket system 300. For example, the decorative pattern 304 may include characters from cartoons, idols from stage or screen, pictures of animals such as ponies, or any combination thereof. In that regard, a particular individual or household may own a plurality of second connecting sheets or blankets 204 having a decorative pattern 304, and may employ a particular sheet depending on the season or the mood or feeling of the user.

Figure 4:
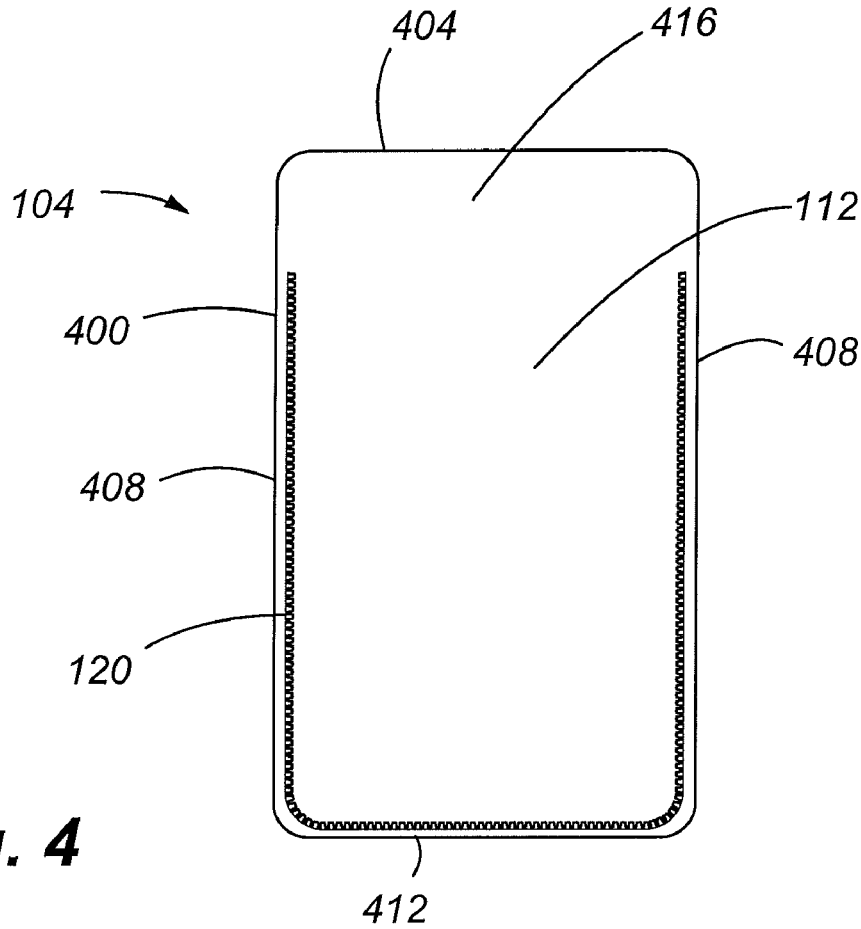
FIG. 4 is a top plan view of a fitted foundation in accordance with embodiments of the present invention.

Turning now to more specific aspects of the various sheets, reference is made to FIG. 4, which shows a top plan view of the fitted foundation sheet 104. The fitted foundation sheet 104 shown in FIG. 4 is usable with any of the sheet and blanket systems 100, 200, 300 described above. As mentioned above, the fitted foundation includes a substantially rectangular sleeping surface 112. The sleeping surface is bounded by a perimeter 400 that includes a top side 404, first and second lateral sides 408, and a bottom side 412. The first interconnecting component 120 is disposed along at least a portion of the perimeter 400. In the embodiment of the present invention shown in FIG. 4, the first interconnecting component 120 is disposed along the bottom side 412 and a portion of each lateral side 408 of the foundation sheet 104. The first interconnecting component 120 is operatively associated with the second interconnecting component 124, which is disposed on the first connecting sheet 108.

Figure 5:
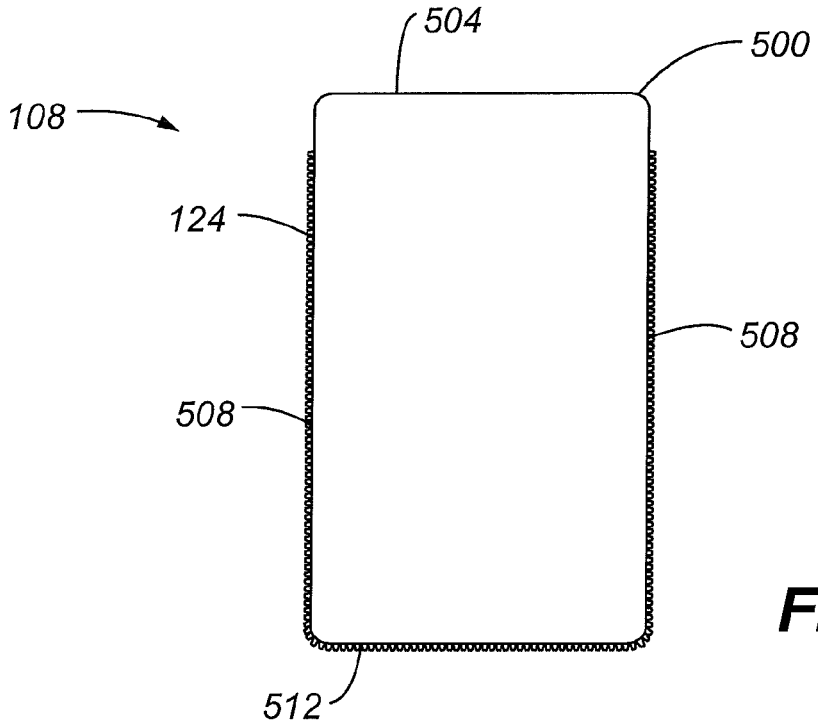
FIG. 5 is a top plan view of a first connecting sheet in accordance with embodiments of the present invention.

FIG. 5 shows a top plan view of an exemplary first connecting sheet 108. The first connecting sheet 108 has a perimeter 500 that includes a top side 504, two lateral sides 508, and a bottom side 512. The second interconnecting component 124 is disposed along at least a portion of the perimeter 500. The exemplary first connecting sheet 108 shown in FIG. 5 is adapted to be attached to the foundation sheet 104 shown in FIG. 4. Accordingly, the second interconnecting component 124 is disposed along the bottom side 512 and each lateral side 508 of the first connecting sheet 108. The fitted foundation 104, shown in FIG. 4, and the first connecting sheet 108, shown in FIG. 5, together comprise the sheet system 100, shown in FIG. 1.

It is noted that, in accordance with embodiments of the present invention, the lengths of the lateral sides 408 of the sleeping surface 112 are longer than the lengths of the lateral sides 508 of the first connecting sheet 108. As a result, an upper portion 416 of the fitted foundation sheet 104 remains uncovered by the first connecting sheet 108. Accordingly, a pillow or other head cushion may be placed in the upper portion 416 of the fitted foundation sheet 104.

Figure 6:
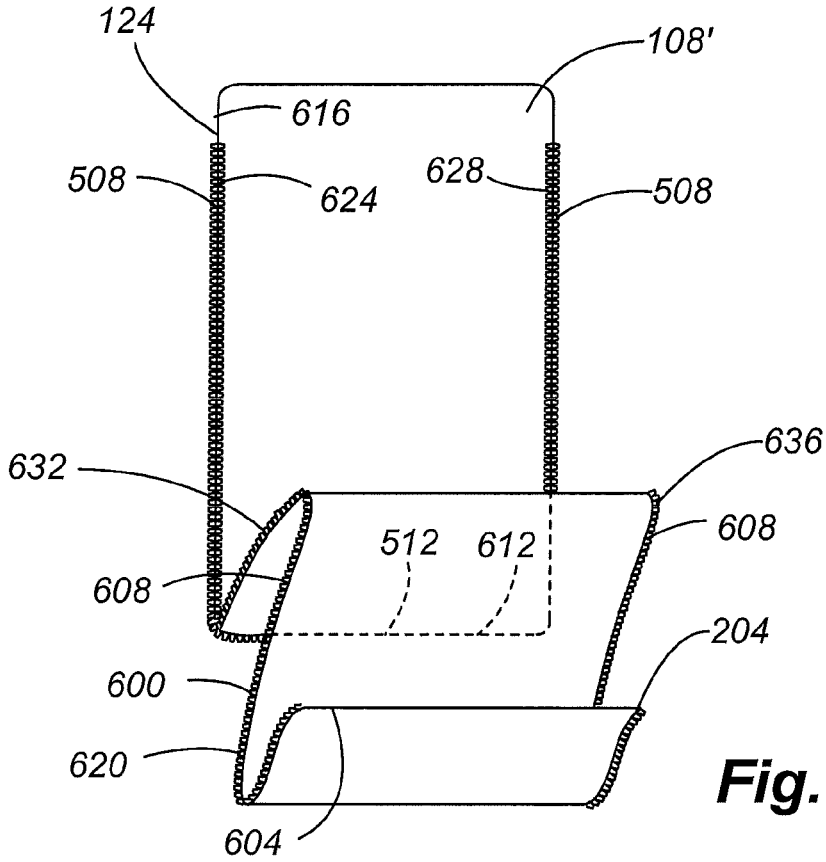
FIG. 6 is a top plan view of a first and second connecting sheet and/or blanket in accordance with embodiments of the present invention.

FIG. 6 shows a top plan view of a first connecting sheet 108' that includes a fixed attachment to a second connecting sheet or blanket 204. The second connecting sheet or blanket 204 has a perimeter 600 that includes a top side 604, two lateral sides 608, and a bottom side 612. As shown in FIG. 6, the bottom side 612 of the second connecting sheet or blanket 204 is sewn or stitched to the bottom side 512 of the first connecting sheet 108. Additionally, the first connecting sheet 108' and the second connecting sheet or blanket 204 are partially detachable from each other. In particular, a third interconnecting component 616 is disposed along a portion of the perimeter 500 of the first connecting sheet 108'. The third interconnecting component 616 is operatively associated with a fourth interconnecting component 620 disposed on a portion of the perimeter 600 of the second connecting sheet 204. More particularly, the third interconnecting component 616 includes a first portion 624 disposed one lateral side 508 of the first connecting sheet 108', and a second portion 628 disposed on the other lateral side 508.

Similarly, the fourth interconnecting component 620 includes a first portion 632 disposed along one lateral side 608 of the second connecting sheet 204, and a second portion 636 disposed along the other lateral side 608. Together, the third 616 and fourth interconnecting components 620 may constitute zippers or other suitable attaching devices. The fitted foundation sheet 104 shown in FIG. 4 and the first 108' and second connecting sheets 204 shown in FIG. 6, together may comprise the sheet system 200 shown in FIG. 2 (shown without a decorative pattern), or the sheet and blanket system 300 shown in FIG. 3 (shown with a decorative pattern).

Figure 7A:
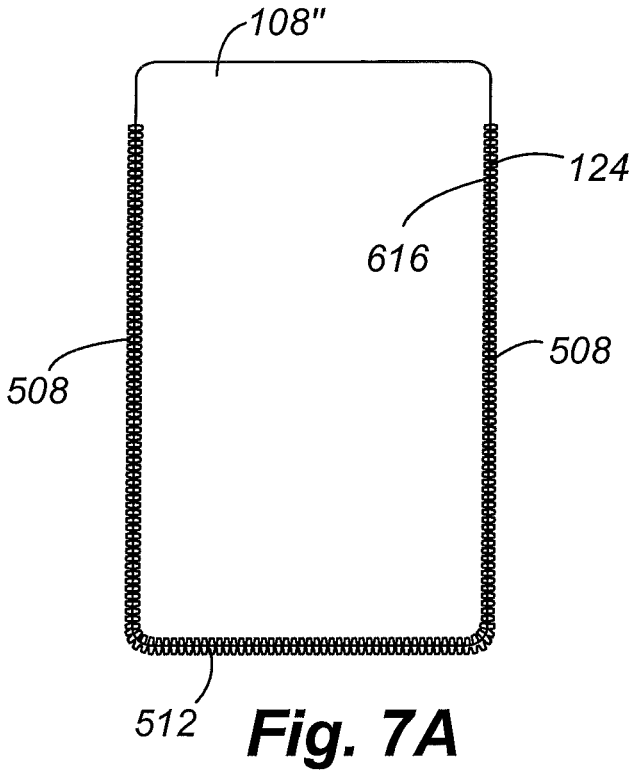
FIG. 7A is a top plan view of a first connecting sheet in accordance with another embodiment of the present invention.
Figure 7B:
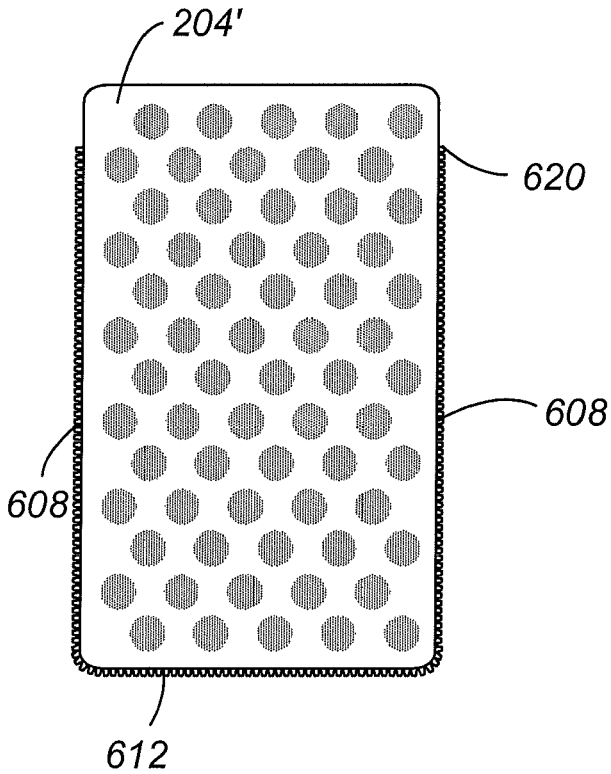
FIG. 7B is a top plan view of a second connecting sheet and/or blanket in accordance with another embodiment of the present invention.

FIG. 7A and FIG. 7B respectively show a first connecting sheet 108" and second connecting sheet 204' that are completely detachable from each other. In particular, a third interconnecting component 616 is associated with first connecting sheet 108 and is disposed along the bottom 512 and the two lateral sides 508. Similarly, the fourth interconnecting component 620 is associated with the second connecting sheet or blanket 108 and is disposed along the bottom side 612 and the two lateral sides 608. Together, the third 616 and the fourth interconnecting components 620 may constitute a zipper or other suitable attaching device. The fitted foundation 104 shown in FIG. 4, the first connecting sheet 108" shown in FIG. 7A and the second connecting sheets or blankets 204' shown in FIG. 7B, together may comprise the sheet system 200 shown in FIG. 2 (without a decorative pattern), or the sheet and blanket system 300 shown in FIG. 3 (with a decorative pattern).

Figure 8A:
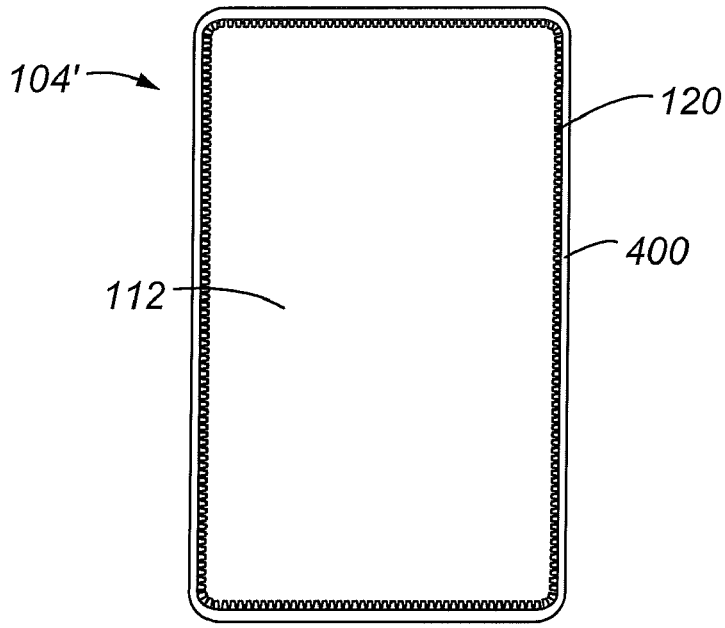
FIG. 8A is a top plan view of a fitted foundation in accordance with yet another embodiment of the present invention.
Figure 8B:
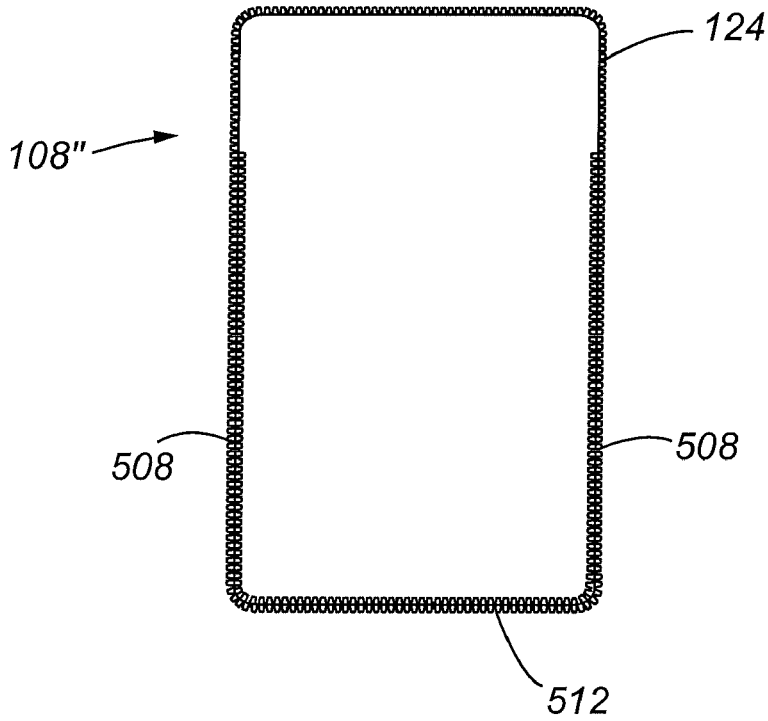
FIG. 8B is a top plan view of a connecting sheet for use in combination with the fitted foundation shown in FIG. 8A.

In accordance with embodiments of the present invention, a first connecting sheet 108 may completely cover the sleeping surface 112 of the foundation sheet. Accordingly, the sleeping space or pocket 128 is provided between the first connecting sheet and the second connecting sheet or blanket. FIG. 8A shows a foundation sheet 104' having a first interconnecting component 120 disposed around the entire perimeter 400 of the sleeping surface 112. This foundation sheet 104' may be associated with the first connecting sheet 108" shown in FIG. 8B. The first interconnecting component 120 is adapted to be selectively interconnected to a second interconnecting component 124, which is disposed along the entire perimeter 500 of the first connecting sheet 108" A third interconnecting component 616 is additionally associated with first connecting sheet 108". The third interconnecting component 616 is disposed along the bottom side 512 and the two lateral sides 508 and is operable to provide an attachment between the first connecting sheet 108" and a second connecting sheet or blanket (such as the connecting sheet 204' shown in FIG. 7B).

Figure 9A:
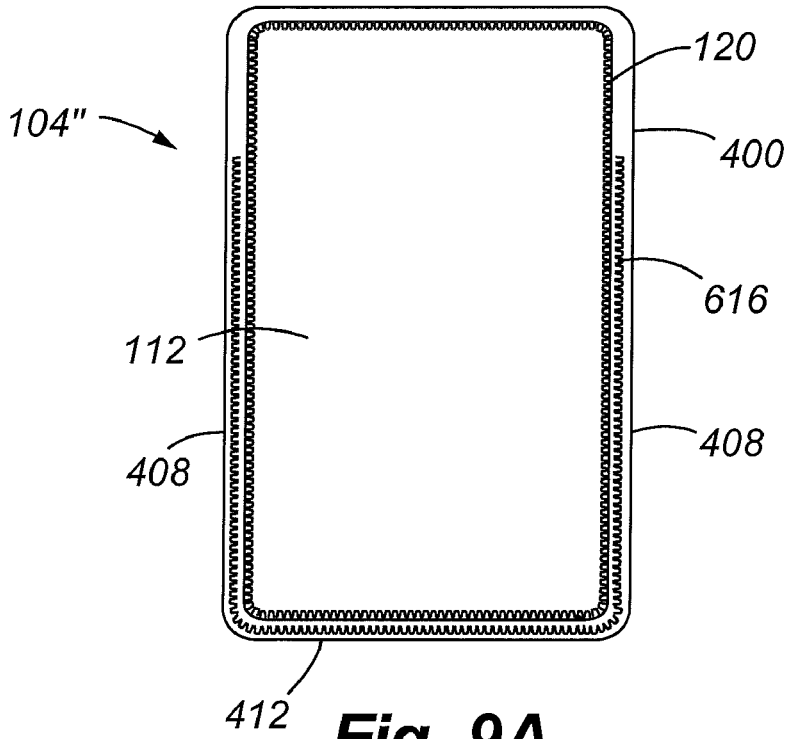
FIG. 9A is a top plan view of a fitted foundation in accordance with still another embodiment of the present invention.
Figure 9B:
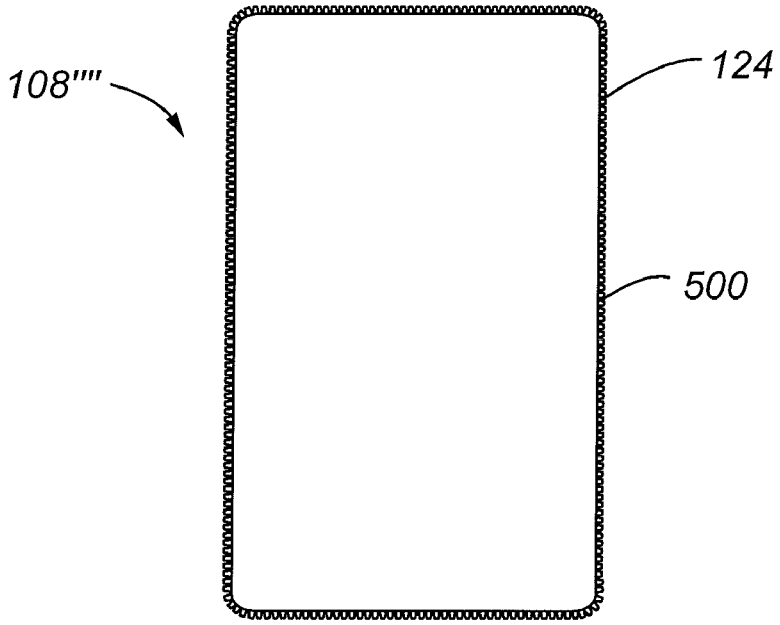
FIG. 9B is a top plan view of a connecting sheet for use in combination with the fitted foundation shown in FIG. 9A.

Still another embodiment of the present invention is shown in FIG. 9A and FIG. 9B. FIG. 9A includes a foundation sheet 104" having a first interconnecting component 120 disposed 10 around the entire perimeter 400 of the sleeping surface 112. The first interconnecting component 120 is operatively associated with the second interconnecting component 124 disposed around the entire perimeter 500 of the first connecting sheet 108"" shown in FIG. 9B. In contrast to the embodiment depicted in FIG. 8A and FIG. 8B, the third interconnecting component 616 is associated with the foundation sheet 104. In particular, the third interconnecting component 616 is disposed along the bottom side 412 and a portion of the two lateral sides 408 and is operable to provide an attachment between the foundation sheet 104" and a second connecting sheet (such as the connecting sheet 204 shown in FIG. 7B).

The various inventive bed sheets and blankets described herein may be, used in connection with any size mattress. For instance, the inventive bed sheet and blanket system may be sized to be used in connection with a single mattress, a twin mattress, a double mattress, queen mattress, a king mattress, a bunk bed mattress, or the like. Moreover, the inventive bed sheet and blanket system may be made of any suitable material, such as, for example: cotton, flannel, jersey, polyester, silk, or a combination thereof. Additionally, one or more pockets may be included in the inventive bed sheet and blanket system providing varying degrees of insulation.

Figure 10:
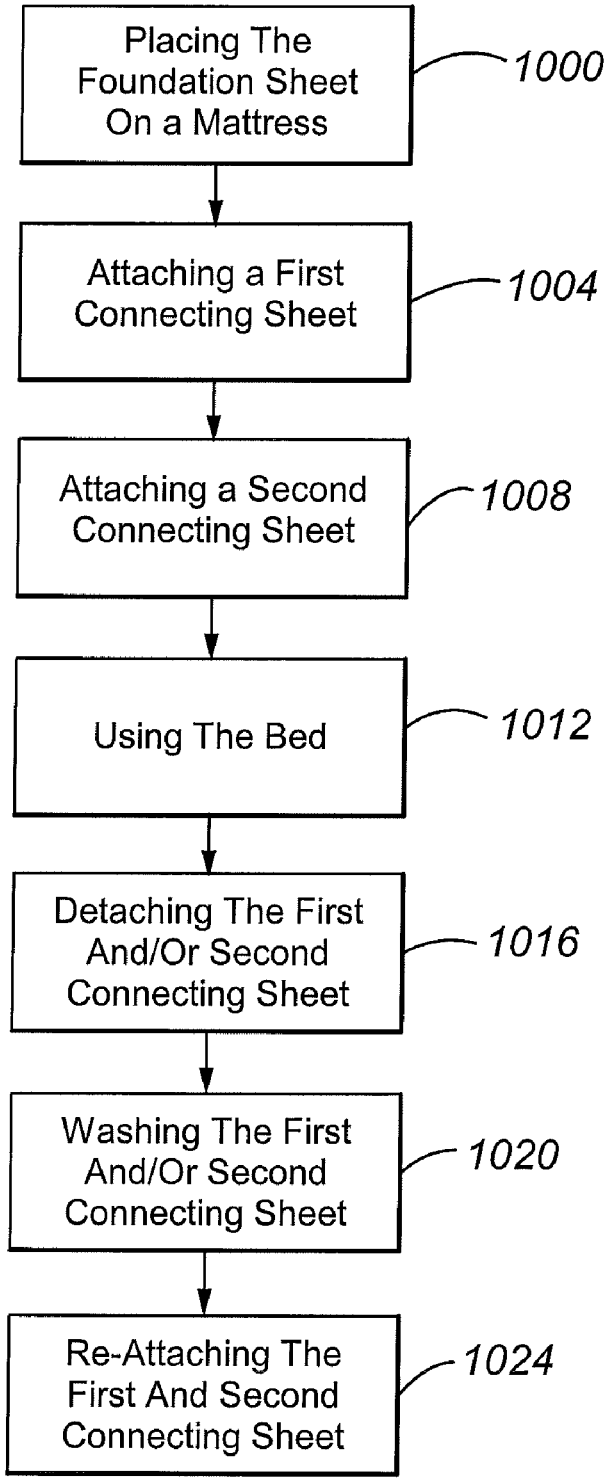
FIG. 10 is a flowchart depicting aspects of a method in accordance with embodiments of the present invention.

Turning now to a method of using a sheet and a blanket arrangement in accordance with embodiments of the present invention, reference is made to FIG. 10. Initially, at step 1000, a fitted foundation sheet 104 is placed on a mattress. At step 1004, a first connecting sheet 108 is interconnected to the foundation sheet 104. This may be accomplished by connecting the two sheets using the first 120 and second interconnecting components 124, as described herein.

For example, one half of a zipper assembly provided as the first interconnecting component 120 may 11 be connected to a second half of a zipper assembly provided by the second interconnecting component 124. The two half zippers may be connected and disconnected by the action of a zipper tab. Optionally, at step 1008, a second connecting sheet or blanket 204 may be attached to either the first connecting sheet 108 or the foundation sheet 104. As described herein, this may be accomplished using the third 616 and fourth interconnecting components 620. At step 1012, the bed is used for sleeping.

Using the bed may include at least partially disconnecting the foundation sheet 104 from the first connecting sheet 108 to provide access to the pocket or pockets 128. Alternatively, the first connecting sheet 108 may be partially disconnected from the second connecting sheet or blanket 204 to provide access to the pocket or pockets 128. At step 1016, the first connecting sheet 108 and/or the second connecting sheet 204 are detached.

For example, where the interconnecting components 120 and 124 comprise portions of a zipper assembly, the sheets and blankets 108 and 204 can be disconnected from one another by unzipping the interconnecting components 120 and 124. At step 1020, the first connecting sheet 108 and/or the second connecting sheet or blanket 204 to be washed. Finally, at step 1024 the first connecting sheet 108, the second connecting sheet or blanket 204, or both may be reattached to the mattress for use.

The foregoing discussion of the invention has been presented for purposes of illustration and description. Further, the description is not intended to limit the invention to the form disclosed herein. Consequently, variations and modifications commensurate with the above teachings within the skill or knowledge of the relevant art are within the scope of the present invention. The embodiments described herein above are further intended to explain the best mode presently known of practicing the invention and to enable others skilled in the art to utilize the invention in such or in other embodiments and with the various modifications required by the particular application or use of the invention. It is intended that the appended claims be construed to include alternative embodiments to the extent permitted by the prior art.

What is claimed is:

1. A method of bed covering, comprising:

first placing on a mattress a foundation fitted thereto to form a sleeping surface thereon, the sleeping surface defining first edges comprising a first head edge, first foot edge, first left edge, and first right edge, and the foundation having a corresponding head side, foot side, left side, and right side descending, respectively, from the sleeping surface to the bottom of the mattress;

the first placing, wherein a first interconnecting component is secured to the foundation to extend substantially continuously along the first foot edge, first left edge, and first right edge;

second placing, on the foundation, a first cover defining second edges comprising second foot, second left, second right, and second head edges thereof, the first cover being provided with a second interconnecting component and third interconnecting component, each extending concurrently and adjacent one another, each being secured to the first cover along the same at least two second edges, selected from the second foot, second left, and second right edges;

first engaging, by a first interconnecting component, of the second interconnecting component, effectively securing the first cover to the sleeping surface at the first edges, substantially continuously during sleeping of a user on the sleeping surface;

the first engaging, wherein the first interconnecting component is secured to the foundation and extends substantially continuously along the first foot edge, most of the first left edge, and most of the first right edge;

the first engaging, wherein the second interconnecting component is secured to the first cover and extends substantially continuously along the second foot edge, left edge, and right edge;

third placing, on the first cover, a second cover, defining third edges comprising a third foot, left, and right edge, and being provided with a fourth interconnecting component extending substantially continuously along the third foot, right, and left edges;

second engaging, by the fourth interconnecting component, of the third interconnecting component, effectively securing the second cover to the first cover by connecting the second and third edges substantially continuously;

the second engaging, wherein the fourth interconnecting component extends substantially continuously along the first cover; and leaving exposed the first foot side, first left side, first right side, and first head side of the foundation by the first and second covers.

2. The method of claim 1, wherein the first and fourth interconnecting components are matched to be mutually engaging with one another by removing the first cover.

3. The method of claim 2, wherein:

the first and second interconnecting components are formed to be selectively detachable from one another;

the third and fourth interconnecting components are selectively detachable from one another; and the foundation and the first cover are interconnected by the first and second interconnecting components to form a pocket between the foundation and first cover.

4. The method of claim 3, further comprising:

accessing the pocket by at least partially disengaging the first interconnecting component from the second interconnecting component along at least one of the first right and left sides to allow a person access between the sleeping surface and the surrounding environment.

5. The method of claim 1, further comprising:

detaching the second attachment component on the first cover from the second attachment component on the foundation;

washing the first cover independently from the foundation; and interconnecting the first cover to the foundation along the first edges and second edges, respectively to form the pocket.

6. The method of claim 1, wherein the first and second interconnecting components are selected from the group consisting of a zipper and a hook-and-loop fastener, and the second cover comprises an insulating material operating as a blanket.

7. A method of using a bed covering, the method comprising:

placing a foundation on a mattress;

the placing the foundation, wherein the foundation is fitted to an outer surface of the mattress;

the placing the foundation, wherein the foundation further comprises a sleeping surface defining a foundation perimeter of first edges extending continuously and comprising a first head edge, first right edge, first foot edge, and first left edge;

the placing the foundation, wherein the foundation further comprises first sides extending to the bottom of the mattress, the first sides including a head side extending down from the first head edge, a right side extending down from the first right edge, a foot side extending down from the first foot edge, and a left side extending down from the first left edge;

the placing the foundation, wherein the foundation further comprises a first interconnecting component disposed continuously from the first foot edge to the first left edge and therealong, and continuously from the first foot edge to the first right edge and therealong;

placing a first cover on the sleeping surface to extend between the first right edge, first left edge and first foot edge;

the placing the first cover, wherein the first cover comprises a first cover perimeter continuously extending along second edges comprising a second foot edge, second right edge, second head edge, and second left edge;

connecting the first interconnecting component to a second interconnecting component disposed to extend continuously along the second foot edge to the second left edge and therealong, and to extend continuously along the second foot edge to the second right edge and therealong, continually connecting the first interconnecting component to the second interconnecting component during sleeping of a user on the sleeping surface;

placing a second cover on the first cover;

the placing a second cover, wherein the second cover further comprises a perimeter of edges comprising a third foot edge, third right edge, third head edge, and third left edge;

the placing a second cover, further comprising interconnecting a fourth interconnecting component and a third interconnecting component along a path extending continuously along the third foot edge to the third right edge and therealong, and continuously along the third foot edge to the third left edge and therealong; and the placing the first cover and placing the second cover, further comprising leaving exposed the foundation below the first edges.

8. The method of claim 7, wherein the third interconnecting component is disposed adjacent and coextensive with the second interconnecting component.

9. The method of claim 8, wherein the first and second covers are permanently secured to one another proximate the second and third foot edges.

10. The method of claim 8, wherein the first and second interconnecting components extend coextensively, substantially continuously, to form a pocket between the foundation and the first cover.

11. The method of claim 10, further comprising:

providing access to the pocket by separating a portion of the first interconnecting component from the second interconnecting component proximate the first head edge.

12. The method of claim 11, further comprising moving past the separated portions of the first interconnecting component and second interconnecting component by a person to complete at least one of entering and exiting the sleeping surface.

13. The method of claim 11, further comprising closing by connecting the separated portions of the first interconnecting component and second interconnecting component by a person inside the pocket.

14. The method of claim 7, further comprising:

separating the foundation from the first cover by detaching the second interconnecting component from the first interconnecting component;

washing the first cover independent of the foundation; and interconnecting the first cover to the foundation along the first and second interconnecting components to form a pocket.

15. The method of claim 7, wherein the appearance of the second cover matches at least one of the first foot side, first right side, and second right side left exposed by the first and second covers.

16. The method of claim 7, further comprising:

separating the foundation from the first cover by detaching the second interconnecting component from the first interconnecting component;

separating the second cover from the first cover by detaching the fourth interconnecting component from the third interconnecting component;

washing the first cover independently from at least one of the foundation and the second cover; and interconnecting the first cover to the foundation along the first and second interconnecting components to form a pocket.

17. A method of making a bed, the method comprising:

placing a fitted foundation on a mattress, the fitted foundation comprising a sleeping surface having a perimeter comprising a pair of lateral sides, a top side, and a bottom side and including a first attachment component disposed continuously along the bottom side and at least a portion of the lateral sides;

interconnecting a first connecting cover to the fitted foundation, the connecting cover comprising a perimeter having a pair of lateral sides, a top side, and a bottom side and including a second attachment component disposed continuously along the bottom side and at least a portion of the lateral sides;

interconnecting a third interconnecting component along a portion of the perimeter of the first connecting cover, the third interconnecting component including first and second portions each disposed along one of the lateral sides of the first connecting cover;

interconnecting a fourth interconnecting component along a portion of a perimeter of a second connecting cover comprising a pair of lateral sides, a top side, and a bottom side, wherein the fourth interconnecting component including first and second portions each disposed along one of the lateral sides of the second connecting cover, the first and second connecting covers being fixedly secured to one another along the bottom sides thereof;

wherein the fitted foundation and the first connecting cover are interconnected through an engagement of the first attachment component with the second attachment component along a first continuous path to form a pocket continually during sleeping of a user therein;

wherein the first connecting cover and the second connecting cover are interconnected through an engagement of the third interconnecting component with the fourth interconnecting component;

wherein the second interconnecting component and the third interconnecting component are both secured to the first connecting cover proximate the edge thereof;

accessing the pocket, including at least partially disconnecting the first connecting cover from the fitted foundation along at least two contiguous sides of the first continuous path to allow a person to enter or exit the sleeping space disposed therebetween;

detaching the first attachment component of the fitted foundation from the second attachment component of the first connecting cover along the first continuous path;

washing the connecting cover independent of the fitted foundation;

interconnecting the first and second interconnecting components;

interconnecting the third and fourth interconnecting components; and leaving the foundation substantially exposed to view and not covered by the first interconnecting cover below the perimeter of the sleeping surface of the foundation.

* * * * *